US008414164B2

(12) United States Patent
Ogawa et al.

(10) Patent No.: US 8,414,164 B2
(45) Date of Patent: Apr. 9, 2013

(54) LIGHTING SYSTEM

(75) Inventors: Kozo Ogawa, Yokosuka (JP); Aiko Takahashi, Yokohama (JP); Nobuhiko Betsuda, Yokohama (JP); Hiroki Tamai, Yokosuka (JP); Kiyoshi Nishimura, Yokosuka (JP); Akiko Saito, Yokohama (JP); Ryotaro Matsuda, Yokosuka (JP)

(73) Assignee: Toshiba Lighting & Technology Corporation

( * ) Notice: Subject to any disclaimer, the term of this patent is extended or adjusted under 35 U.S.C. 154(b) by 0 days.

(21) Appl. No.: 12/471,579

(22) Filed: May 26, 2009

(65) Prior Publication Data

US 2009/0296412 A1 Dec. 3, 2009

(30) Foreign Application Priority Data

May 28, 2008 (JP) ..... 2008-139782
Mar. 13, 2009 (JP) ..... 2009-061909

(51) Int. Cl.
*F21V 29/00* (2006.01)

(52) U.S. Cl.
USPC ..... 362/373; 362/294; 362/371

(58) Field of Classification Search ..... 362/294, 362/373, 370, 371, 404, 419, 420
See application file for complete search history.

(56) References Cited

U.S. PATENT DOCUMENTS 5,788,363 A * 8/1998 Kamaya et al. ..... 362/285
7,651,245 B2 * 1/2010 Thomas et al. ..... 362/294
7,753,556 B1 * 7/2010 Zhang et al. ..... 362/373
2006/0250803 A1 11/2006 Chen
2008/0068839 A1 3/2008 Matheson
2009/0027900 A1 * 1/2009 Janos et al. ..... 362/373
2009/0097264 A1 * 4/2009 Dunn ..... 362/373
2009/0237934 A1 * 9/2009 Zeng et al. ..... 362/249.03

FOREIGN PATENT DOCUMENTS

| | | | |
|---|---|---|---|
| CN | 2763684 | Y | 3/2006 |
| CN | 101160490 | A | 4/2008 |
| EP | 1059202 | A2 | 12/2000 |
| EP | 1174307 | A2 | 1/2002 |
| EP | 2128516 | A2 | 5/2009 |
| JP | 6-162805 | A | 6/1994 |
| JP | 2005-071821 | A | 3/2005 |
| WO | WO 2005054696 | A1 | 6/2005 |
| WO | 2007/097262 | A1 | 8/2007 |

OTHER PUBLICATIONS

European Search Report for corresponding European Patent Application No. 09251395.1 (Published as EP 2128516 A3 on Apr. 25, 2012) completed on Mar. 2, 2012.
Japanese Office Action with partial translation issued in Japanese Application No. 2009-061909 issued on Nov. 14, 2012.

* cited by examiner

*Primary Examiner* — Y My Quach Lee
(74) *Attorney, Agent, or Firm* — McDermott Will & Emery LLP

(57) ABSTRACT

A spotlight is provided with a substrate having LEDs disposed thereon and a main body casing on which the substrate is provided. The main body casing has a rear side portion having thermal conductivity, which is thermally coupled to the substrate, and is capable of changing the irradiation angle of light emitted from the LEDs. A plurality of heat-radiating fins for forming grooves operating as a plurality of convection paths along the direction of changing the irradiation angle are provided on the rear side portion of the main body casing.

1 Claim, 19 Drawing Sheets

LIGHTING SYSTEM

CROSS REFERENCE TO PRIOR APPLICATIONS AND INCORPORATION BY REFERENCE

The present invention claims priority under 35 U.S.C. §119 to Japanese Patent Application Nos. 2008-139782 and 2009-061909 filed on May 28, 2008 and Mar. 13, 2009, respectively. The contents of these applications are incorporated herein by reference in their entirety.

FIELD OF THE INVENTION

The present invention relates to a lighting system, in which light emitting elements such as LEDs are used, capable of changing the irradiation angle of light.

BACKGROUND OF THE INVENTION

With respect to light emitting elements such as LEDs, an increase in temperature lowers the optical output, varies the characteristics thereof and further adversely influences the service life thereof. Therefore, in a light source unit using light emitting elements, for example, LEDs and EL elements as a light source, it is necessary to prevent the temperature of the light emitting elements from rising for the purpose of improving the service life and various characteristics pertaining to efficiency.

Conventionally, as described in, for example, Japanese Laid-Open Patent Publication No. 2005-71821, such a lighting system has been known, in which a lighting device having LEDs as a light source is made so as to turn with respect to its supporting body to make the irradiation direction changeable and a concavo-convex shape for heat radiation is formed on the rear side of the main body.

However, although Japanese Laid-Open Patent Publication No. 2005-71821 shows a concavo-convex shape for heat radiation on the rear side of the main body, it does not show a detailed heat-radiating structure where the LEDs are used as a light source, and a concavo-convex shape for heat radiation is not associated with a change in the irradiation direction, that is, the direction of an elevation angle. Therefore, with the structure shown in Japanese Laid-Open Patent Publication No. 2005-71821, it is difficult to effectively prevent the temperature of the LEDs from rising.

The present invention has been developed in order to solve the above-described problems, and it is therefore an object of the invention to provide a lighting system capable of effectively preventing the temperature of a substrate, on which light emitting elements are disposed, from rising.

SUMMARY OF THE INVENTION

A lighting system according to the present invention includes: a substrate having light emitting elements disposed thereon; a main body casing having the substrate provided thereon and having a rear side portion having thermal conductivity, which is thermally coupled to the substrate, and being capable of changing the irradiation angle of light emitted from the light emitting element; and a heat-radiating fin portion including heat-radiating fins formed on the rear side portion of the main body casing and forming a plurality of convection paths along the direction of changing the irradiation angle.

The light emitting element is a solid-state light emitting element such as an LED, an organic EL, an inorganic EL, etc. There is no restriction with respect to the disposing system of the light emitting elements, which is not limited to a surface mount system, a chip-on-board system, etc. For example, cannon ball type LEDs may be used and be disposed on a substrate. Also, there is no restriction with respect to the number of disposing light emitting elements. Being thermally coupled to a substrate permits a case of being directly brought into contact with a substrate and a case of heat being indirectly transmitted. Further, a convection path may be formed to be linear or so as to meander.

According to the invention, since a plurality of convection paths are formed along the direction of changing of the irradiation angle, only some convection paths will be formed from the down side direction of the main body casing to the upside direction thereof at least where the irradiation direction is perpendicularly down or up. Accordingly, a heat-radiating effect can always be obtained easily based on convections even if the irradiation angle is changed, wherein it is possible to prevent the difference in temperature condition of a substrate from becoming large for respective irradiation angles, and the range of change in the light emission efficiency of light emitting elements can be made smaller.

Therefore, a lighting system can be provided, which is capable of effectively preventing the temperature of a substrate having light emitting elements disposed from rising. Furthermore, a lighting system can be provided, which is capable of reducing the degree of change in convections and heat-radiating actions in line with the change in the irradiation angle and capable of reducing the influence of the light emitting elements on temperature characteristics.

According to the lighting system of the present invention, the light emitting elements are disposed at the middle part of the substrate, and the height dimension of the heat-radiating fins at the heat-radiating fin portion is made gradually higher from the outer circumference of the rear side portion of the main body casing toward the middle part thereof.

Gradually becoming higher from the outer circumference of the rear side part of the main body casing toward the middle part thereof means to include a case of gently becoming higher like a curved line and a case of becoming higher intermittently, that is, in a stepwise manner.

And, since the area of heat radiation at the middle part at which heat is likely to be concentrated can be increased, heat radiation can be efficiently carried out, and the degree of change in convections and heat-radiating actions in line with the change in the irradiation angle can be further reduced, wherein it is possible to provide a lighting system capable of reducing the influence of the light emitting elements on temperature characteristics.

The lighting system according to the present invention, further includes: a hanging element, having thermal conductivity, for hanging the main body casing; and an irradiation angle changing mechanism for connecting the hanging element and the main body casing with each other so as to be able to change the irradiation angle of light, which is composed so that the change in the contact area between the hanging element side and the main body casing side is made less with respect to a change in the irradiation angle of light, and is formed of a member having thermal conductivity.

The irradiation angle changing mechanism means an element for enabling to change the irradiation angle of the main body casing so as to change the irradiation direction of light, wherein there is no special restriction in view of the structure thereof. Also, thermal conductivity does not mean that a material is not necessarily composed of a member having a high thermal conduction ratio but that the material is composed so that it may contribute at least to a heat-radiating action. For example, a metallic material or a resin material may be applicable.

And, since heat can be radiated from the hanging element via an irradiation angle changing mechanism even if the irradiation angle is changed, it is possible to reduce the degree of change in heat-radiating action in line with the change in the irradiation angle.

DETAILED DESCRIPTION OF THE INVENTION

Figure 1:
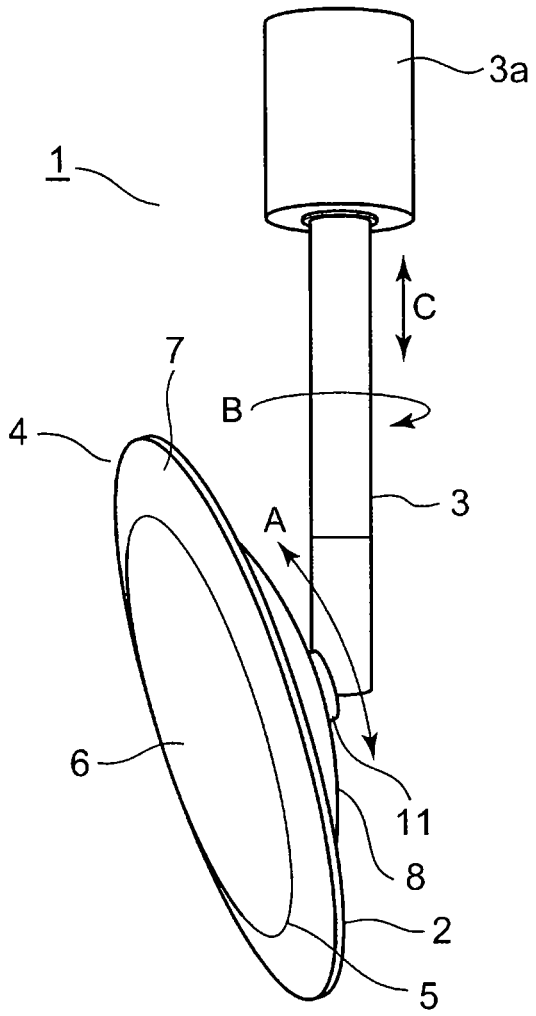
FIG. 1 is a perspective view showing a side of a spotlight as a lighting system according to an embodiment of the present invention.
Figure 3:
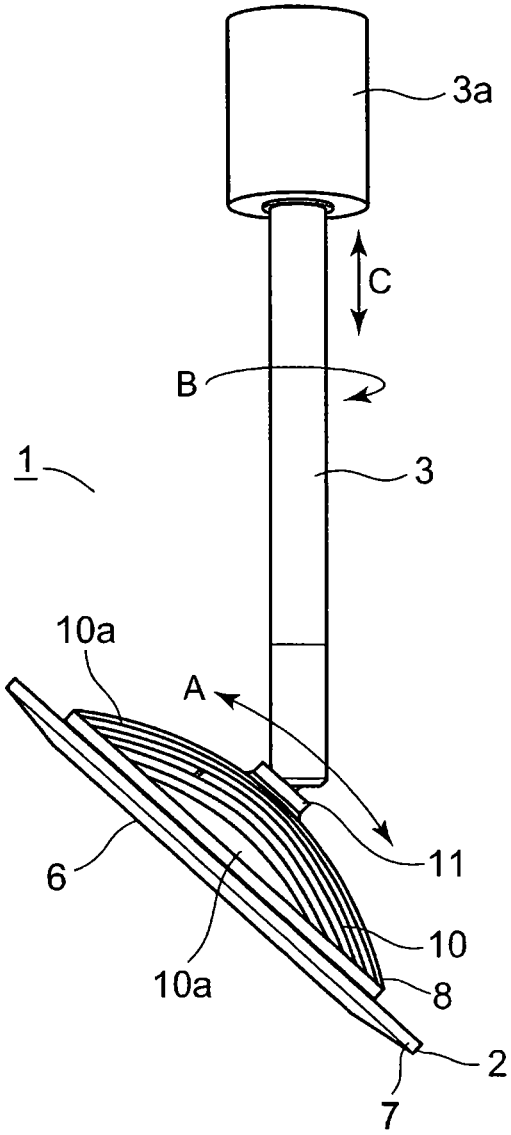
FIG. 3 is a side elevational view of the same spotlight.
Figure 4:
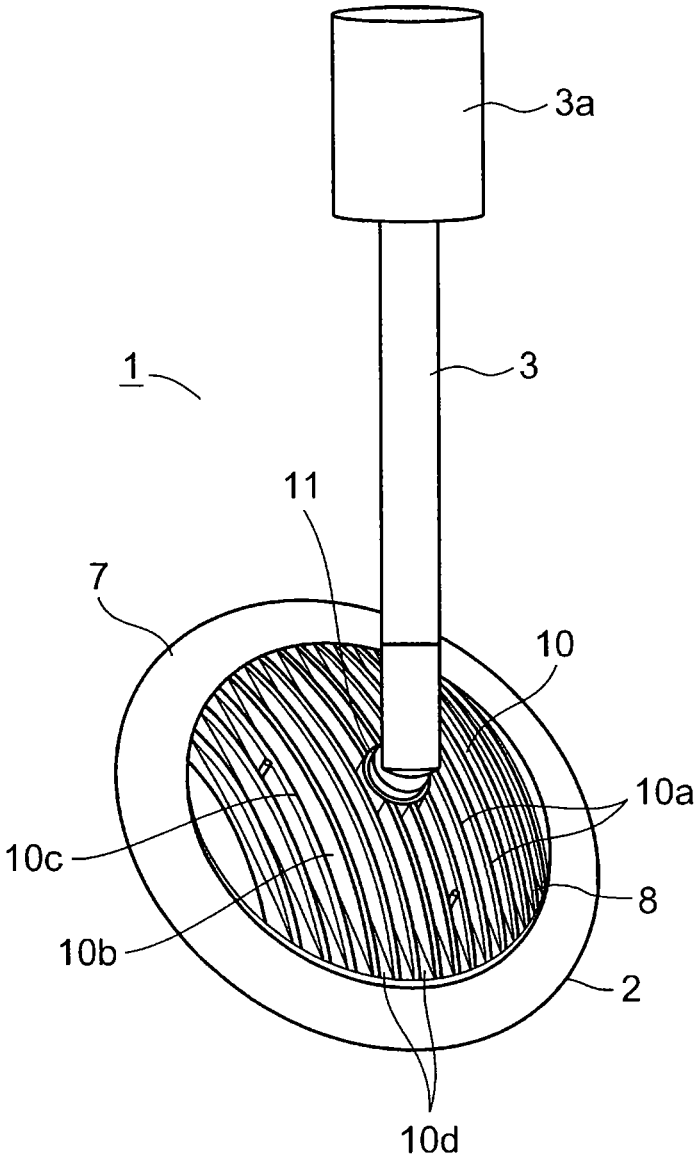
FIG. 4 is a rear side view of the same spotlight.
Figure 5:
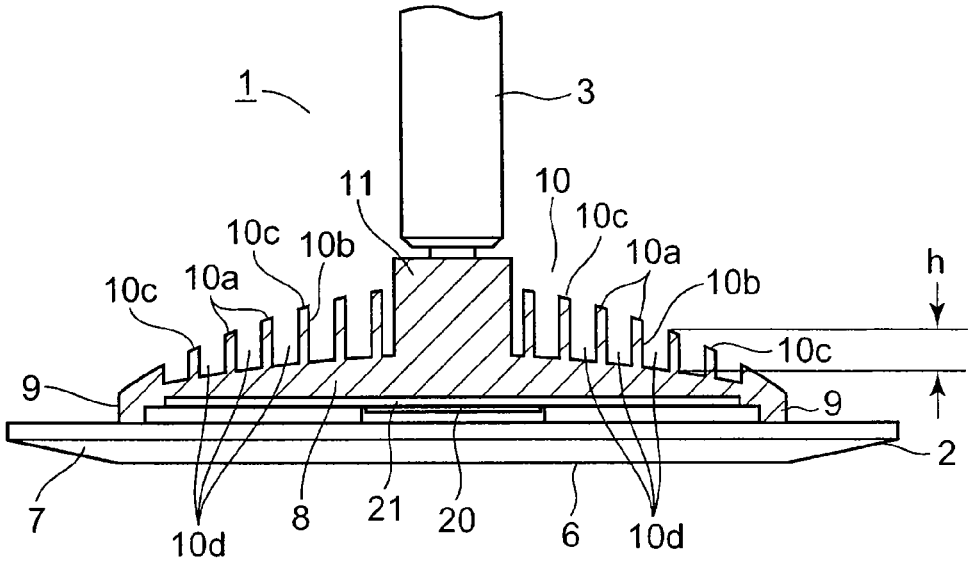
FIG. 5 is a sectional view of the same spotlight.
Figure 6:
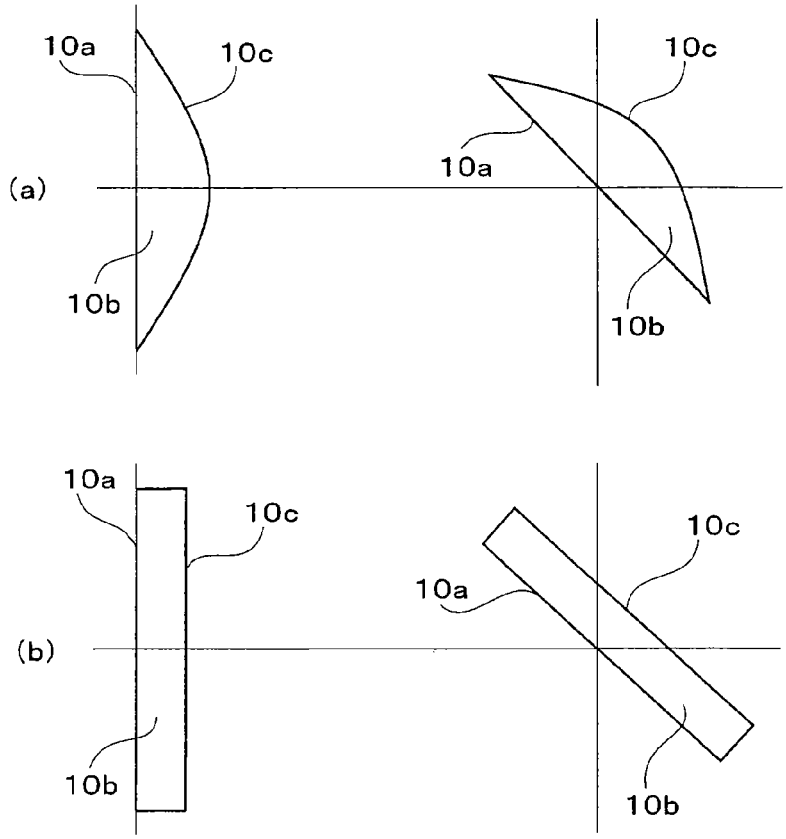
FIG. 6 is a schematic view describing a heat-radiating action of the same spotlight using (a) and (b).

Hereinafter, a description is given of a lighting system according to an embodiment of the present invention with reference to FIG. 1 through FIG. 6. FIG. 1 is a perspective view showing the side of a spotlight as a lighting system, FIG. 2 is a perspective view showing the front side of the same spotlight, FIG. 3 is a side elevational view of the same spotlight, FIG. 4 is a rear side view of the same spotlight, FIG. 5 is a sectional view of the same spotlight, and FIG. 6 is a schematic view showing a heat-radiating action of the same spotlight using (a) and (b).

Figure 2:
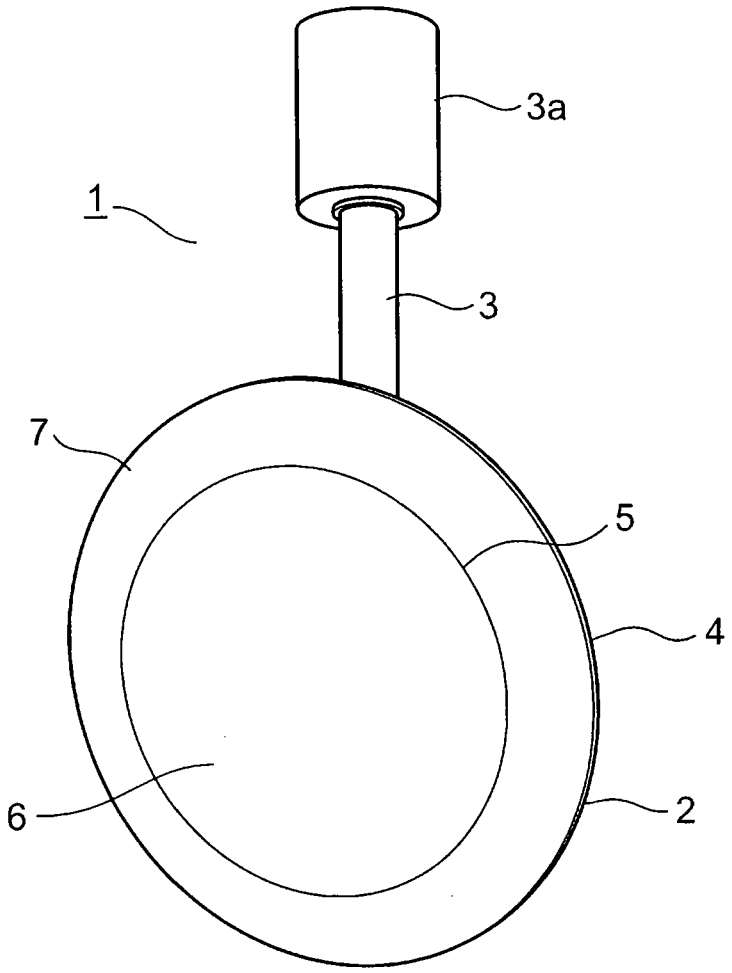
FIG. 2 is a perspective view showing the front side of the same spotlight.

In FIG. 1 and FIG. 2, the lighting system is, for example, a spotlight 1 used in a state where it is hung from a ceiling surface, etc., and is provided with a main body 2 and a hanging rod 3 operating as hanging element.

The main body 2 is formed to be roughly disk-shaped in its appearance, and is composed of a main body casing 4 and a diffusion cover 6 to enclose an irradiation opening portion of the main body casing 4. Further, the main body casing 4 is composed of a ring-shaped front side decorative frame 7 and a rear side portion 8 the outer surface of which is formed to be spherical. The ring-shaped front side decorative frame 7 is formed of a synthetic resin material such as ABS resin, and composes an irradiation opening portion 5 by using its inside circular opening. A milky white light-permeable diffusion cover 6 formed of acrylic resin is attached to the irradiation opening portion 5. The rear side portion 8 is formed of a material having favorable thermal conductivity, which is produced by aluminum die-casting as described in detail later. If the thermal conductivity is ensured, the rear side portion 8 may be formed of other materials such as thermally conductive resin.

The hanging rod 3 is pipe-shaped, one end of which is connected to the rear side portion 8, and to the other end of which an attaching portion 3*a* attached to the ceiling surface, etc., is connected. Based on a connection structure with the hanging rod 3, the main body 2, that is, the main body casing 4 can be turned in the direction of the elevation angle (arrow A in FIG. 1). In addition, the hanging rod 3 maybe turned around the axis thereof (arrow B in FIG. 1). Further, the hanging rod 3 may move in the axial direction (arrow C in FIG. 1), that is, be subjected to a telescopic motion in the up and down direction in the drawing. Therefore, the main body 2 may be set in an optional direction and position by friction. Accordingly, the irradiation direction may be optionally changed.

In FIG. 3 through FIG. 5, the rear side portion 8 is formed to be circular, and a heat-radiating fin portion 10 is formed thereon. A plurality of linear heat-radiating fins 10*a* are formed on the heat-radiating fin portion 10. These heat-radiating fins 10*a* are formed to be roughly semi-circular in view of the shape of the side 10*b*, and the appearance formed by the upper surface (rear side) 10*c* of a plurality of heat-radiating fins 10*a* is formed to be spherical as its entirety. Therefore, grooves 10*d* operating as a plurality of linear convection paths are formed between the respective heat-radiating fins 10*a*. Also, the height dimension h (refer to FIG. 5) of a plurality of heat-radiating fins 10*a* is formed so as to become gradually higher from the outer circumference of the rear side portion 8 toward the middle part thereof. With such a configuration, the surface area of the heat-radiating fins 10*a* at the middle part of the heat-radiating fin portion 10 is increased, and the heat-radiating fins 10*a* further come out to the exterior surface by the differential in accordance with a difference in height dimension h between the respective adjacent heat-radiating fins 10*a* (Mainly refer to FIG. 3 and FIG. 5). In addition, the direction of a plurality of grooves 10*d* is made into a turning direction of the elevation angle of the main body casing 4, that is, a direction roughly along the direction for changing the elevation angle. Also, a connection portion 11 connected to the hanging rod 3 is formed at the center of the heat-radiating fin portion 10.

The rear side portion 8 has a side circumferential wall 9, wherein a front side decorative frame 7 is attached to the side circumferential wall 9 of the rear side portion 8, thereby composing the main body casing 4. Further, the side circumferential wall 9 and the rear side portion 8 may be formed to be separate from each other.

A substrate 21 on which LEDs 20 operating as a plurality of light emitting elements are disposed is attached in the main body casing 4. A plurality of LEDs 20 are mounted on the substrate 21 by the chip-on-board system. That is, such a structure is adopted, in which a plurality of LEDs 20 are disposed on the surface of the substrate 21 in the form of a matrix with predetermined spacing therebetween, and a coating material is coated on the surface thereof. Accordingly, the mounted surface of the LEDs 20 is made into a light-emitting surface of the substrate 21. The rear side of the substrate 21 is face-contacted with the inner wall of the rear side portion 8 and is thermally coupled thereto. The face contacting may be carried out on not only the entire rear side of the substrate 21 but also a partial rear side thereof. Further, an adhesive agent may intervene between the substrate 21 and the rear side portion 8. In this case, a material having favorable thermal conductivity, in which a metal oxide, etc., is blended with a silicone resin-based adhesive agent may be used as the adhesive agent.

The substrate 21 is formed of a roughly circular flat plate of metallic or insulative material. Where the substrate 21 is made of a metallic material, it is preferable that a material having favorable thermal conductivity and excellent heat radiating property such as aluminum is adopted. Where the substrate 21 is made of an insulative material, a ceramic material or a synthetic resin material, which is excellent in heat-radiating property and is excellent durability, may be adopted. Where the synthetic resin material is used, for example, the substrate 21 may be formed of glass epoxy resin, etc.

In addition, a lighting circuit (not illustrated) is disposed at the peripheral side of the substrate 21 on the surface side of the substrate 21 on which the LEDs 20 are mounted. The lighting circuit is composed of components such as a capacitor, a resistor element, a switching element, and controls lighting of the LEDs 20. In addition, the lighting circuit is permitted to be sealed and disposed in the substrate 21 or to be provided outside the main body casing 4.

Next, a description is given of actions of the spotlight 1 thus constructed.

First, the elevation angle etc. of the main body casing 4 is adjusted, and the light-emitting surface is turned to a desired irradiation direction. If power is supplied to the lighting circuit and electricity is supplied to the LEDs 20, light emitted from the LEDs 20 passes through the diffusion cover 6 and is irradiated forward.

On the other hand, heat generated at the LEDs 20 in line therewith is mainly transmitted from roughly the entire surface of the rear side of the substrate 21 to the rear side portion 8, is further thermally transmitted to a plurality of heat-radiating fins 10*a*, and is finally radiated. Herein, since the grooves 10*d* between a plurality of heat-radiating fins 10*a* are provided along the direction of the elevation angle of the main body casing 4, convections based on natural convection operate on the side 10*b* of the heat-radiating fins 10*a*, wherein heat radiation is efficiently carried out. Also, the action can be reliably carried out since the grooves 10*d* are provided along the direction of changing the elevation angle even if the elevation angle of the main body casing 4 is changed. Also, since the surface area of the heat-radiating fins 10*a* at the middle part of the heat-radiating fin portion 10 is increased, which is opposed to the middle part of the substrate 21, although heat is likely to be concentrated at the middle part of the substrate 21, it is possible to effectively radiate heat at the middle part. Further, based on differences in the height dimension h between the heat-radiating fins 10*a* adjacent to each other, the heat-radiating fins are caused to come out to the exterior surface by the differentials thereof, wherein the heat-radiating effect can be accelerated.

In addition, a consideration is given of the convection and heat radiation on the upper surface 10*c* of the heat-radiating fins 10*a* with reference to FIG. 6. As shown in FIG. 6(*a*), the shape of the side 10*b* of the heat-radiating fin 10*a* is roughly semi-circular, and the upper surface 10*c* is curved. That is, such a configuration is adopted in which the height dimension of the heat-radiating fins 10*a* at the heat-radiating fin portion 10 gradually becomes higher from the outer circumference toward the middle part along the direction of changing the elevation angle. Therefore, even if the elevation angle of the main body casing 4 is changed, the degree of change in convection and heat radiation is only slight, wherein it has been found that influence on temperature characteristics of the LEDs 20 can be reduced.

That is, in connection with a mode in which the shape of the side 10*b* is laterally rectangular and the upper surface 10*c* is linear as shown in FIG. 6(*b*), and a mode in which the shape of the side 10*b* is roughly semi-circular and the upper surface 10*c* is curved as in the present embodiment shown in FIG. 6(*a*), differences in temperature of the substrate 21 have been compared with each other in regard to a vertical state (left view) and an approximately 45° inclined state (right view) through a simulation test. As a result, it was confirmed that the difference in temperature of the substrate 21 between the vertical state (left view) and the approximately 45° inclined state (right view) is slighter in the mode shown in FIG. 6(*a*) than in the mode shown in FIG. 6(*b*).

As described above, according to the present embodiment, since a plurality of grooves 10*d* are formed in the heat-radiating fin portion 10 along the direction of changing the elevation angle, the heat radiation can be efficiently carried out, and it is possible to prevent the temperature of the substrate 21 from rising. In addition, since the surface area of the heat-radiating fins 10*a* opposed to the middle part of the substrate 21 is increased, it is possible to effectively radiate the heat at the middle part of the substrate 21, at which heat is likely to be concentrated. Further, since the heat-radiating fins 10*a* are caused to come out to the exterior surface by the differentials in the height dimension h between the heat-radiating fins 10*a* adjacent to each other, the heat-radiating effect can be accelerated. In addition, since the shape of the side 10*b* of the heat-radiating fin 10*a* is roughly semi-circular and the upper surface 10*c* is curved, the degree of change in convection and heat radiation is only slight even if the elevation angle is changed, wherein it has been found that influence on temperature characteristics of the LEDs 20 can be reduced.

Figure 7:
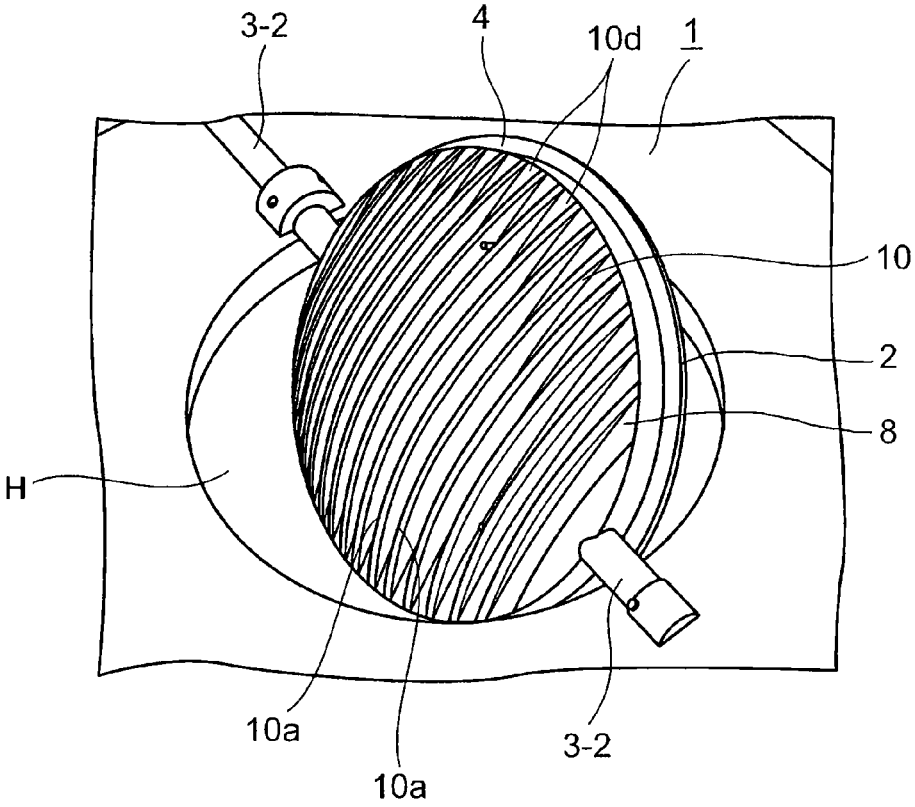
FIG. 7 is a perspective view showing a spotlight as a lighting system according to another embodiment of the present invention.

Next, a description is given of a lighting system according to Embodiment 2 of the present invention with reference to FIG. 7. FIG. 7 is a perspective view of a spotlight operating as the lighting system. Also, components that are identical to or correspond to those of the above embodiment are given the same reference numerals, and overlapping description thereof is omitted.

This embodiment differs from the above embodiment in view of a supporting structure of the main body casing 4. In the previous embodiment, a description was given of such a type in which the main body casing 4 is hung from a ceiling surface, etc., by the hanging rod 3 in use. However, this embodiment relates to such a type in which the main body casing 4 is placed in an opening portion H of a ceiling surface, etc., and both the ends of the main body casing 4 are supported so as to turn by a supporting rod 3-2.

Therefore, the elevation angle of the main body casing 4 can be adjusted, and the irradiation light can be turned to a target place. Also, since a plurality of grooves 10*d* are formed at the heat-radiating fin portion 10 along the direction of changing the elevation angle, heat radiation can be effectively carried out. Further, the main body casing 4 may be installed at not only the ceiling surface but also other wall surfaces or mounting boards.

As described above, according to this embodiment, effects that are similar to those of previous embodiment can be brought about.

Figure 8:
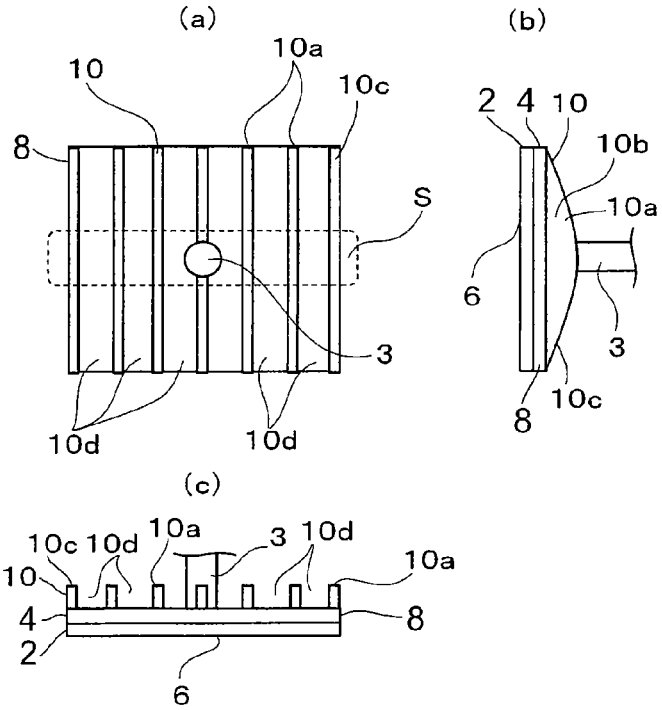
FIG. 8 shows a spotlight as a lighting system according to a further embodiment of the present invention, wherein (a) is a rear side view, (b) is a side elevational view, and (c) is a bottom view.

Next, a description is given of a lighting system according to a further embodiment of the present invention with reference to FIG. 8. FIG. 8 shows a spotlight operating as a lighting system, wherein (a) is a rear side view, (b) is a side elevational view, and (c) is a bottom view. Also, components that are identical to or correspond to those of the above embodiments are given the same reference numerals, and overlapping description thereof is omitted.

In this embodiment, the outer shape of the heat-radiating fin portion 10 is square, and the shape of the side 10*b* of a plurality of heat-radiating fins 10*a* is roughly semi-circular, and the upper surface 10*c* is curved, wherein the height dimensions h are made same. Accordingly, the surface area of the heat-radiating fins 10*a* at the middle part S orthogonal to the linear heat-radiating fins 10*a* is increased.

As described above, according to this embodiment, since a plurality of grooves 10*d* are formed at the heat-radiating fin portion 10 along the direction of changing the elevation angle of the main body casing 4, the temperature of the substrate 21 can be prevented from rising, wherein effects similar to those of the above embodiments can be brought about.

Figure 9:
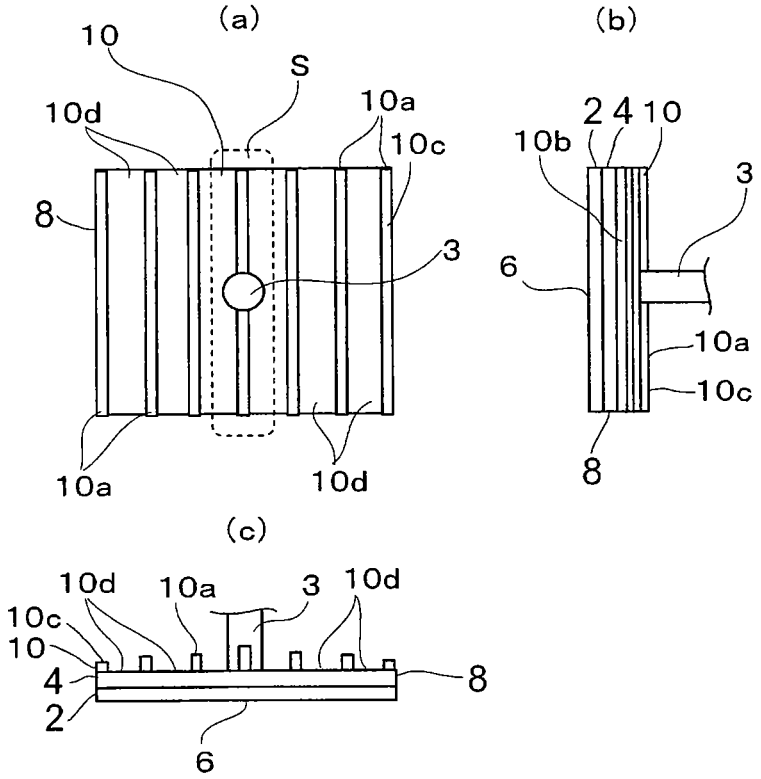
FIG. 9 shows a spotlight as a lighting system according to an embodiment of the present invention, wherein (a) is a rear side view, (b) is a side elevational view, and (c) is a bottom view.

Next, a description is given of a lighting system according to an embodiment of the present invention with reference to FIG. 9. FIG. 9 shows a spotlight operating as a lighting system, wherein (a) is a rear side view, (b) is a side elevational view, and (c) is a bottom view. Also, components that are identical to or correspond to those of the above embodiments are given the same reference numerals, and overlapping description thereof is omitted.

This embodiment is formed so that the outer shape of the heat-radiating fin portion 10 is square, the shape of the side 10*b* of a plurality of heat-radiating fins 10*a* is laterally rectangular, and the height dimension h is made gradually higher from the outer circumference of the rear side part 8 toward the middle part. Accordingly, the surface area of heat-radiating fins 10*a* at the middle part S parallel to the linear heat-radiating fins 10*a* is increased.

As described above, according to this embodiment, since a plurality of grooves 10*d* are formed at the heat-radiating fin portion 10 along the direction of changing the elevation angle of the main body casing 4, the temperature of the substrate 21 can be prevented from rising, and effects similar to those of the above embodiments can be brought about.

Also, with respect to these embodiments a description was given of such a type in which the outer shape of the heat-radiating fin portion 10 is made square. However, the outer shape thereof may be made circular, wherein there is no special restriction with respect to the shape thereof.

Figure 10:
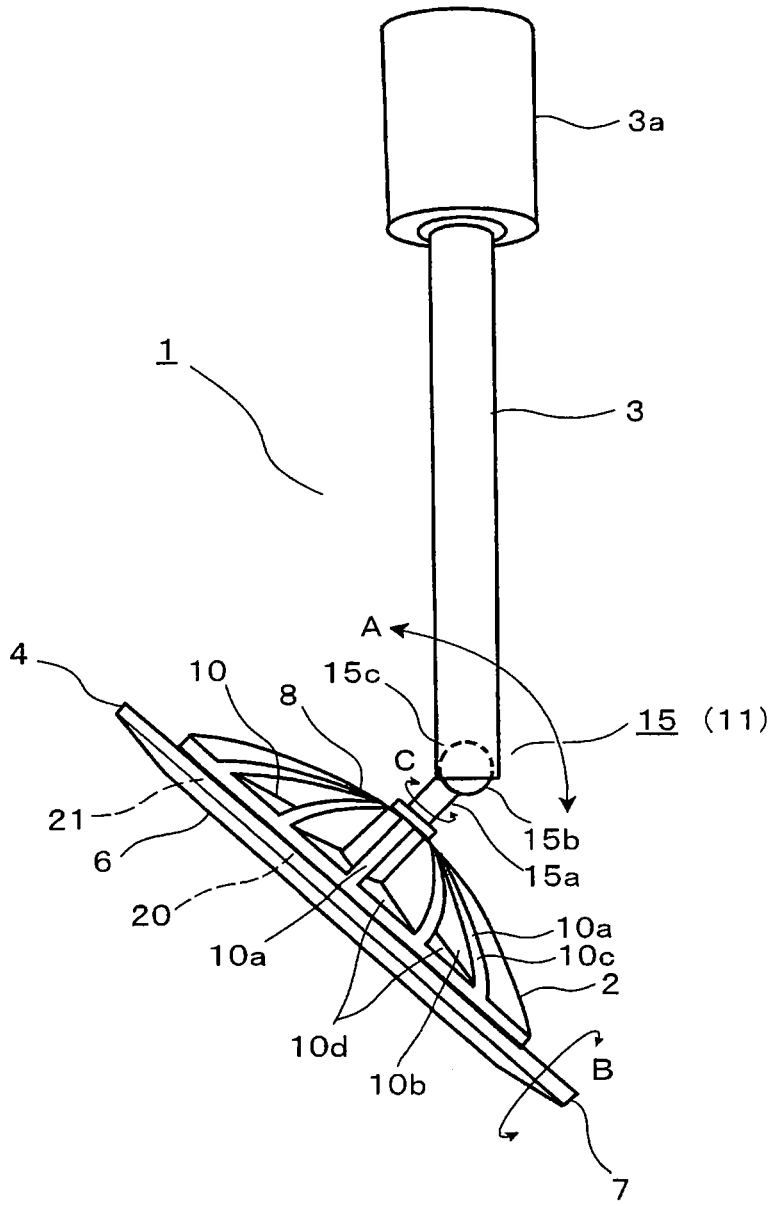
FIG. 10 is a side elevational view showing a spotlight as a lighting system according to another embodiment of the present invention.
Figure 11:
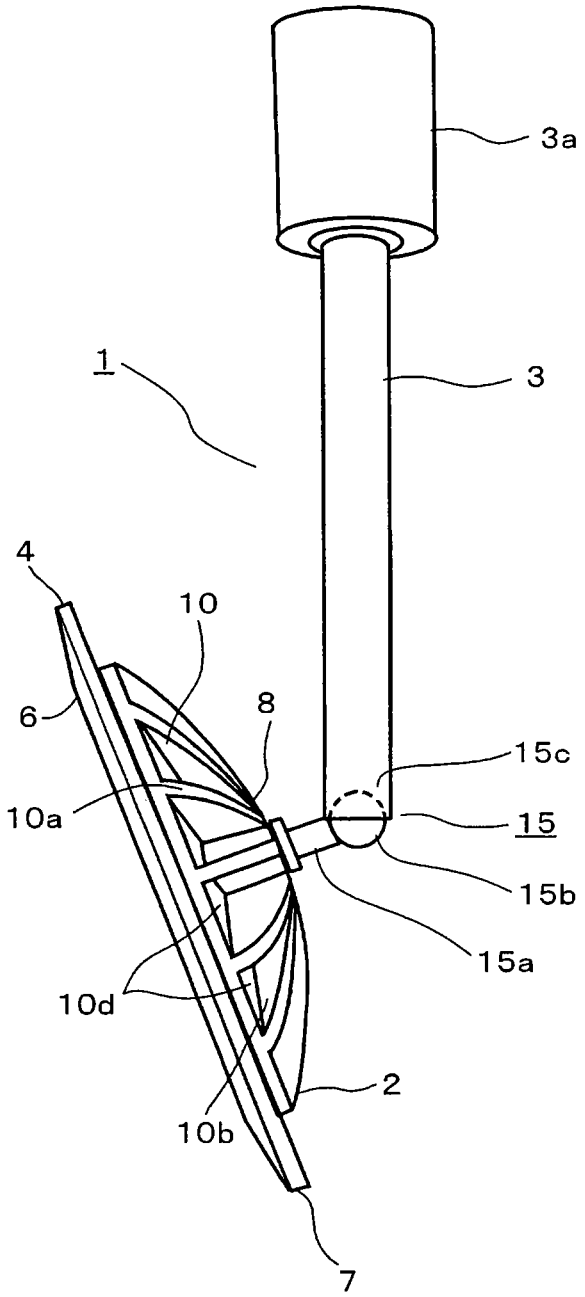
FIG. 11 is a side elevational view of the same spotlight, in which the angle in the elevation angle direction thereof is changed.
Figure 12:
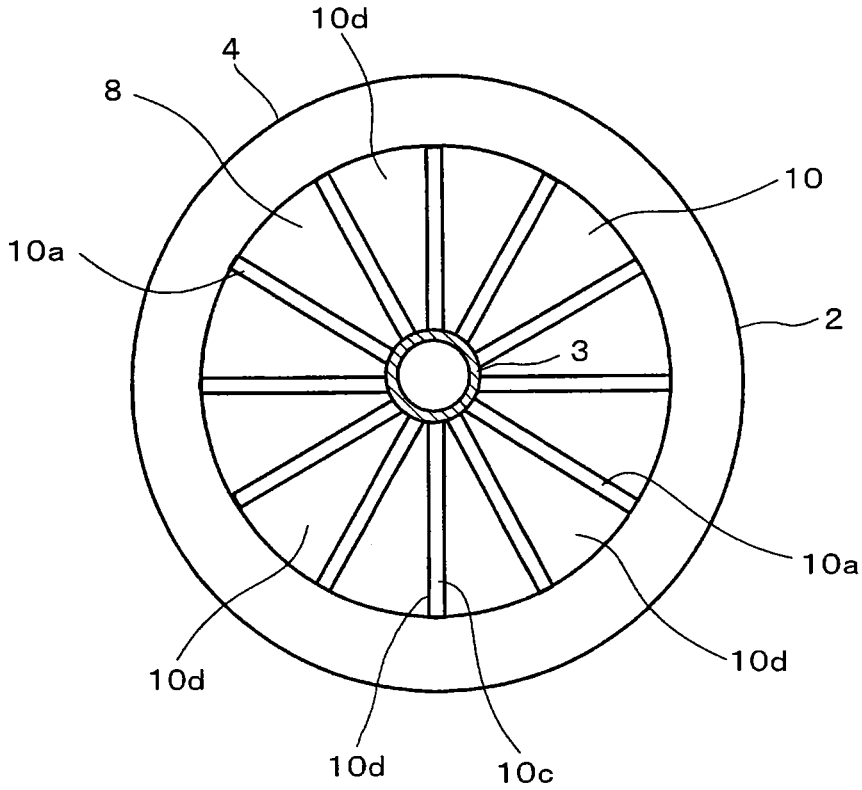
FIG. 12 is a plan view of the same spotlight.

Next, a description is given of a lighting system according to yet another embodiment of the present invention with reference to FIG. 10 through FIG. 12. FIG. 10 is a side elevational view showing a spotlight as a lighting system. FIG. 11 is a side elevational view of the same spotlight, in which the angle in the elevation angle direction thereof is changed. FIG. 12 is a plan view of the same spotlight. Also, components that are identical to or correspond to those of the previous embodiments are given the same reference numerals, and overlapping description thereof is omitted.

The spotlight 1 is provided with the main body 2 and a hanging rod 3 operating as hanging element, which is formed of a material having thermal conductivity such as metal. The rear side portion 8 of the main body casing 4 is formed of a material having favorable thermal conductivity such as aluminum, and a heat-radiating fin portion 10 formed to be circular is formed thereon. Twelve linear heat-radiating fins 10*a* are formed radially from the middle part in the heat-radiating fin portion 10 with equal spacing of approximately 30°. The height dimension of these heat-radiating fins 10*a* is made gradually higher from the outer circumference of the rear side portion 8 toward the middle part thereof. Therefore, the surface area of the heat-radiating fins 10*a* at the middle part of the heat-radiating fin portion 10 is formed so as to increase. With such a configuration, a plurality of roughly fan-shaped radial grooves 10*d*, which are oriented from the outer circumference of the rear side portion 8 toward the middle part thereof and operate as convection paths, are formed between the respective heat-radiating fins 10*a* (Mainly refer to FIG. 12). Further, there is no special restriction on the number of the heat-radiating fins 10*a*, and the number may be appropriately selected in accordance with the design.

In addition, a connection portion 11 that is connected to a pipe-shaped hanging rod 3 is formed at the connection part of the rear side portion 8 of the main body casing 4. The connection portion 11 is composed of an irradiation angle changing mechanism 15. In detail, it is composed of a so-called ball joint. The irradiation angle changing mechanism 15 is provided with a supporting arm 15*a* protruding from the middle part of the rear side portion 8, a spherical ball portion 15*b* formed at the tip end of the supporting arm 15*a*, and a ball bearing portion 15*c* secured at the tip end part of the hanging rod 3. The supporting arm 15*a*, the ball portion 15*b* and the ball bearing portion 15*c* are formed of a material having thermal conductivity such as metal.

The main body casing 4 may be subjected to a change in the angle so as to turn approximately in all the directions using the irradiation angle changing mechanism 15 as a fulcrum. That is, the main body casing 4 may be turned approximately in all the directions including the elevation angle direction (arrow A in FIG. 10) and the direction (arrow B in FIG. 10) orthogonal to the elevation angle direction using the irradiation angle changing mechanism 15 as a fulcrum, and may be turned using the irradiation angle changing mechanism 15 as a fulcrum (arrow C in FIG. 10). These components are optionally established in the direction and position of the main body casing 4 by friction and separately installed fixing element, wherein the irradiation angle of the spotlight 1 may be freely and optionally changed.

Next, a description is given of actions of the spotlight 1 thus constructed. The irradiation angle of the main body casing 4 is adjusted by the irradiation angle changing mechanism 15, and the light-emitting plane is turned to a desired irradiation direction. When power is supplied to the lighting circuit and electricity is supplied to the LEDs 20, light emitted from the LEDs 20 passes through the diffusion cover 6 and is irradiated forward. In line therewith, heat generated at the LEDs 20 is mainly transmitted from roughly the entire surface of the rear side at the middle part of the substrate 21, on which the LEDs 20 are disposed, toward the rear side portion 8, wherein the heat is thermally transmitted and discharged to a plurality of heat-radiating fins 10*a*. Here, since grooves 10*d* that operate as convection paths between a plurality of heat-radiating fins 10*a* are formed along the direction of changing the irradiation angle, that is, are formed radially from the center of the heat-radiating fin portion 10, convections based on natural convections operate on the side 10*b* of the heat-radiating fins 10*a*, wherein heat radiation can be efficiently carried out.

Still further, such an action is reliably carried out since the grooves 10*d* are provided along the direction of changing the irradiation angle and convections can be secured even if the irradiation angle of the main body casing 4 is changed (for example, from a state shown in FIG. 10 to a state shown in FIG. 11). Also, since the surface area of the heat-radiating fins 10*a* at the middle part of the heat-radiating fin portion 10 is increased, which is opposed to the middle part of the substrate 21 although heat is likely to be concentrated at the middle part of the substrate 21, heat radiation can be effectively carried out at the middle part thereof.

Further, since the LEDs 20 have temperature characteristics by which the optical output and light-emitting color, etc., are changed by the temperature, it is necessary to reduce a change in temperature of the LEDs 20. Therefore, where the irradiation angle of the main body casing 4 is changed, the degree of change in convection and heat radiation is reduced so that the optical output and the light emission color do not to change, and it is necessary to make the temperature of the LEDs 20 constant.

In this embodiment, a convection action can reliably be secured even if the irradiation angle is changed since the grooves 10*d* are provided along the direction of changing the irradiation angle. Therefore, the degree of change in heat radiation can be reduced, wherein a change in temperature of the rear side portion 8, the substrate 21 and the LEDs 20 is reduced, and it is possible to prevent influence on temperature characteristics from occurring. Also, it is considered that convections and heat radiation on the upper surface 10*c* of the heat-radiating fins 10*a* also operate thereon.

As described above, the irradiation angle of the spotlight 1 can be optionally changed, and light can be irradiated onto a target direction. Further, since the grooves 10*d* operating as convection paths between a plurality of heat-radiating fins 10*a* are formed along the direction of changing the irradiation angle, heat radiation can be carried out effectively even if the irradiation angle is changed. Still further, a change in temperature is reduced at the LEDs 20, and it is possible to prevent influence on temperature characteristics from occurring.

Figure 13:
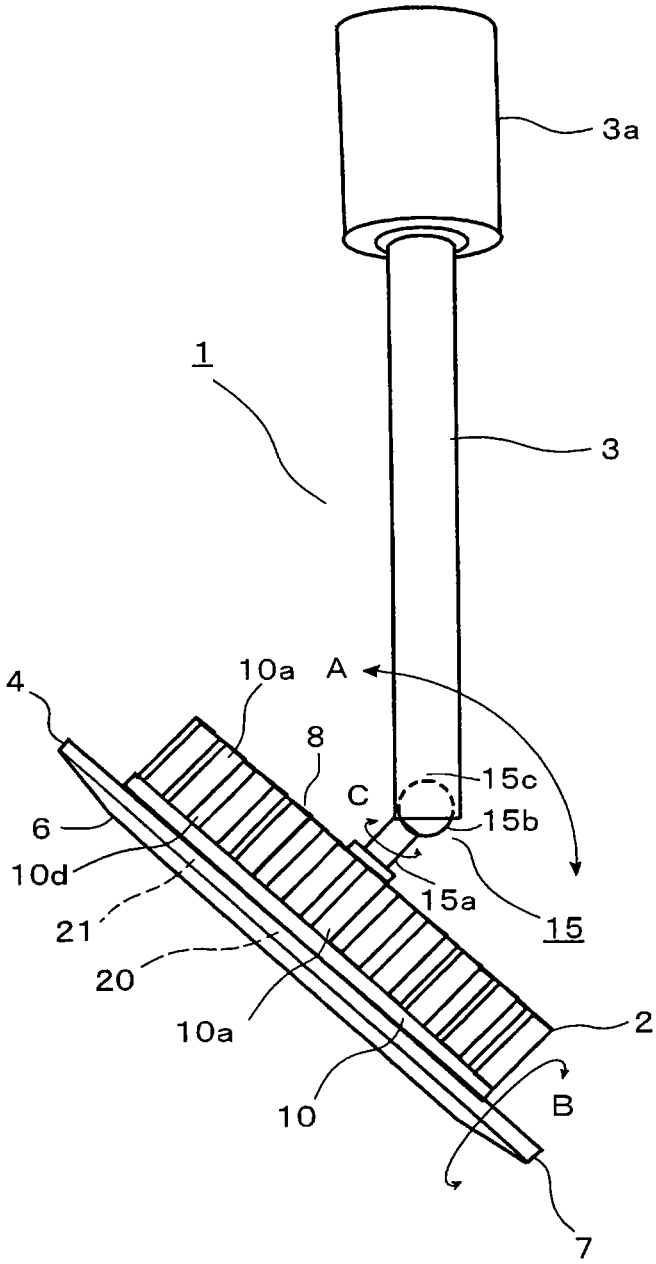
FIG. 13 is a side elevational view showing a spotlight as a lighting system according to a further embodiment of the present invention.
Figure 14:
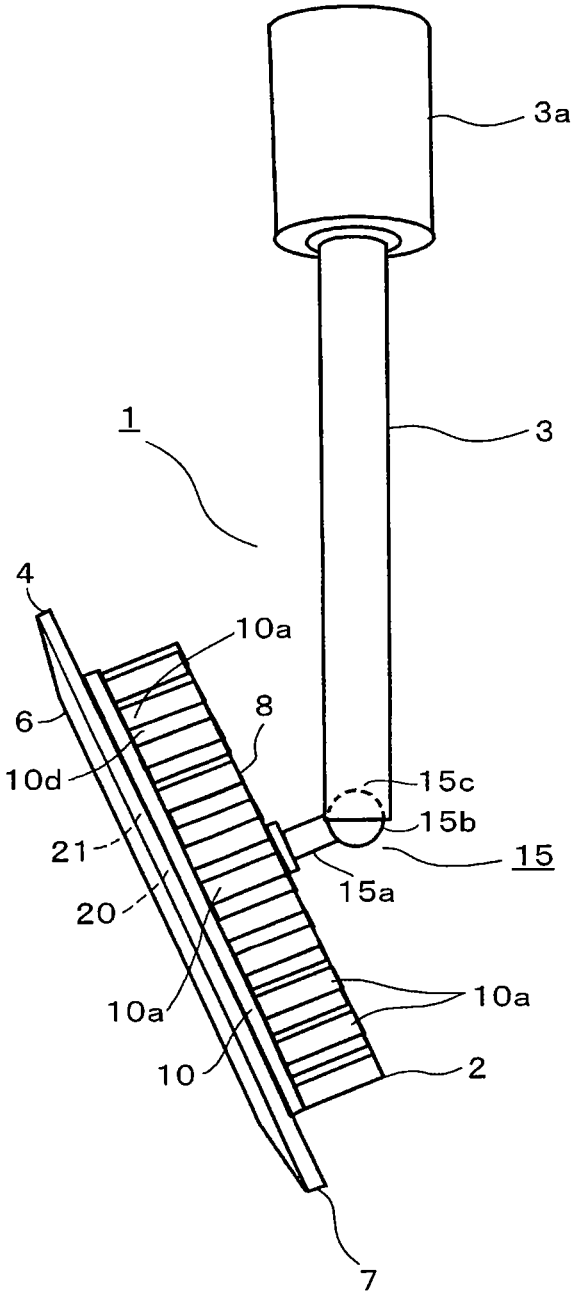
FIG. 14 is a side elevational view of the same spotlight, in which the angle in the elevation angle direction thereof is changed.
Figure 15:
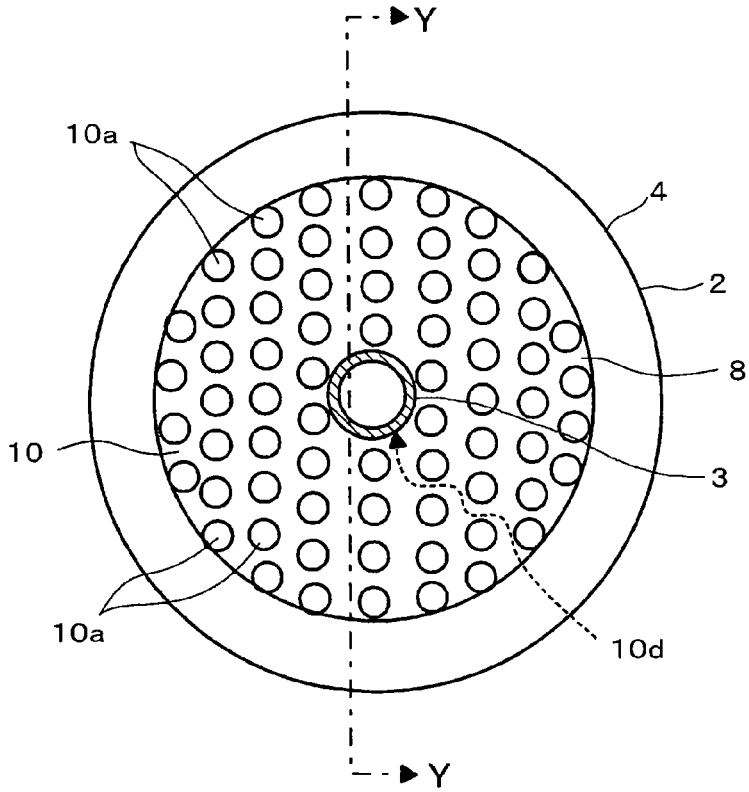
FIG. 15 is a plan view of the same spotlight.
Figure 16:
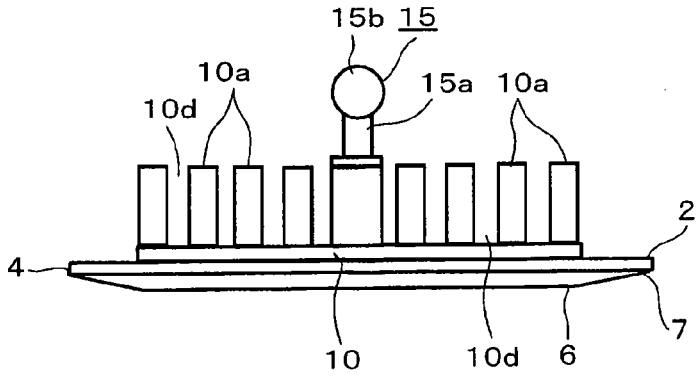
FIG. 16 is a side elevational view schematically showing the shape of heat-radiating fins of the same spotlight.
Figure 17:
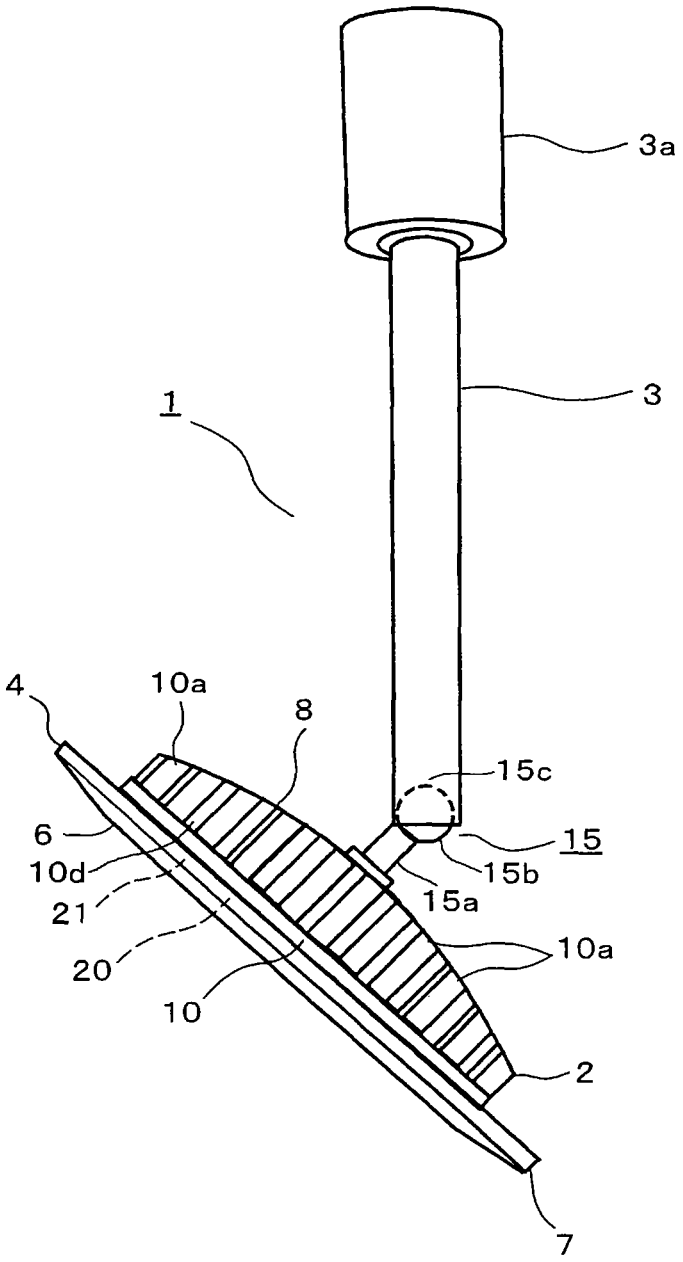
FIG. 17 is a side elevational view showing another example of the same spotlight.

Next, a description is given of a lighting system according to the present invention with reference to FIG. 13 through FIG. 17. FIG. 13 is a side elevational view showing a spotlight as a lighting system. FIG. 14 is a side elevational view of the same spotlight, in which the angle in the elevation angle direction thereof is changed. FIG. 15 is a plan view of the same spotlight. FIG. 16 is a side elevational view schematically showing the shape of heat-radiating fins of the same spotlight. FIG. 17 is a side elevational view showing another example of the same spotlight. Also, components that are identical to or correspond to those of Embodiment 5 are given the same reference numerals, and overlapping description thereof is omitted.

This embodiment differs from previous embodiments in view of a configuration of the heat-radiating fin portion 10 at the rear side portion 8 of the main body casing 4. As shown in FIG. 13 through FIG. 16, a number of heat-radiating fins 10*a*, which are cylindrical and pin-shaped, are formed so as to protrude from and scatter on the heat-radiating fin portion 10 from the middle part thereof toward the peripheral part thereof. The heat-radiating fins 10*a* are formed with spacing therebetween. Therefore, a number of meandering grooves 10*d* (illustrated in FIG. 15) operating as convection paths from the outer circumference of the rear side portion 8 to the middle part thereof will be formed between the respective heat-radiating fins 10*a*.

According to such a configuration, since the meandering grooves 10*d* operating as convection paths between a plurality of heat-radiating fins 10*a* are formed at least along the direction of changing the irradiation angle, wherein convections operate on the outer circumferential side of the heat-radiating fins 10*a*, heat radiation can be efficiently carried out.

Further, such an action can be reliably carried out since the grooves 10*d* are formed along the direction of varying the irradiation angle and the convections can be secured even if the irradiation angle is changed (for example, from a state shown in FIG. 13 to a state shown in FIG. 14), and the degree of change in heat radiation can be reduced, wherein a change in temperature of the LEDs 20 is reduced, and influence on temperature characteristics can be prevented from occurring.

As described above, effects similar to those of previous embodiments can be brought about.

Still further, as shown in FIG. 17, the height dimension of the heat-radiating fins 10*a* may be formed so as to gradually become higher from the outer circumference of the rear side portion 8 toward the middle part thereof, and may be formed so that the surface area of the heat-radiating fins 10*a* at the middle part of the heat-radiating fin portion 10 is increased. Therefore, heat radiation can be effectively carried out at the middle part of the substrate 21 where heat is likely to be concentrated.

Figure 18:
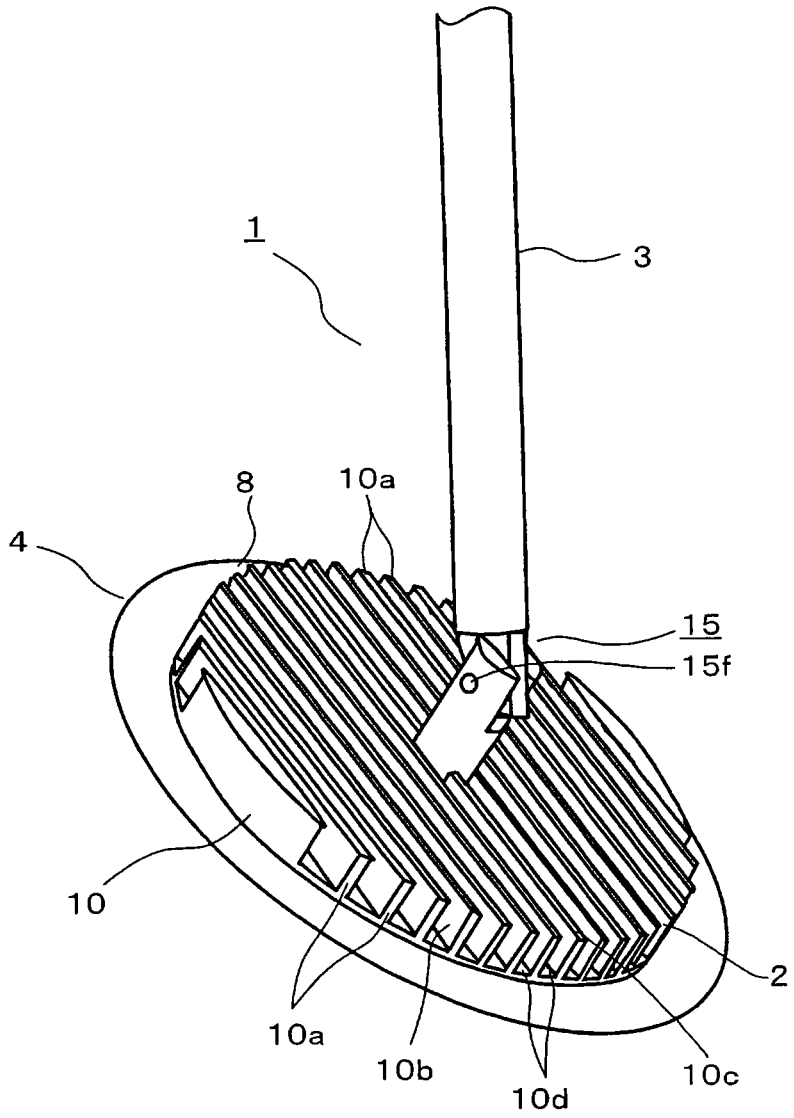
FIG. 18 is a perspective view showing the rear side of a spotlight as a lighting system according to an embodiment of the present invention.

Next, a description is given of a lighting system according to the present invention with reference to FIG. 18. FIG. 18 is a perspective view showing the rear side of a spotlight operating as a lighting system. Also, components that are identical to or correspond to those of above embodiments are given the same reference numerals, and overlapping description thereof is omitted.

In the spotlight 1 such a type is shown in which the elevation angle may be changed as change in the irradiation angle. Therefore, the irradiation angle changing mechanism 15 is constructed so as to turn centering around the connection axis 15*f*. Also, a plurality of linear heat-radiating fins 10*a* are equidistantly formed from one end of the outer circumference to the other end thereof at the heat-radiating fin portion 10 formed on the rear side portion 8 of the main body casing 4, and the shape of the side 10*b* of the heat-radiating fins 10*a* is made roughly rectangular. Therefore, a plurality of linear grooves 10*d* operating as convection paths are formed between the respective heat-radiating fins 10*a*, and further the direction of a plurality of grooves 10*d* is made into the turning direction of the elevation angle of the main body casing 4, that is, the direction along the direction of changing the elevation angle of the main body casing 4.

As described above, since the grooves 10*d* operating as convection paths between a plurality of heat-radiating fins 10*a* are formed along the direction of changing the elevation angle of the main body casing 4, heat radiation can be effectively carried out even if the irradiation angle is changed. Accordingly, a change in temperature of the LEDs 20 can be reduced, and it is possible to prevent influence on temperature characteristics from occurring.

Figure 19:
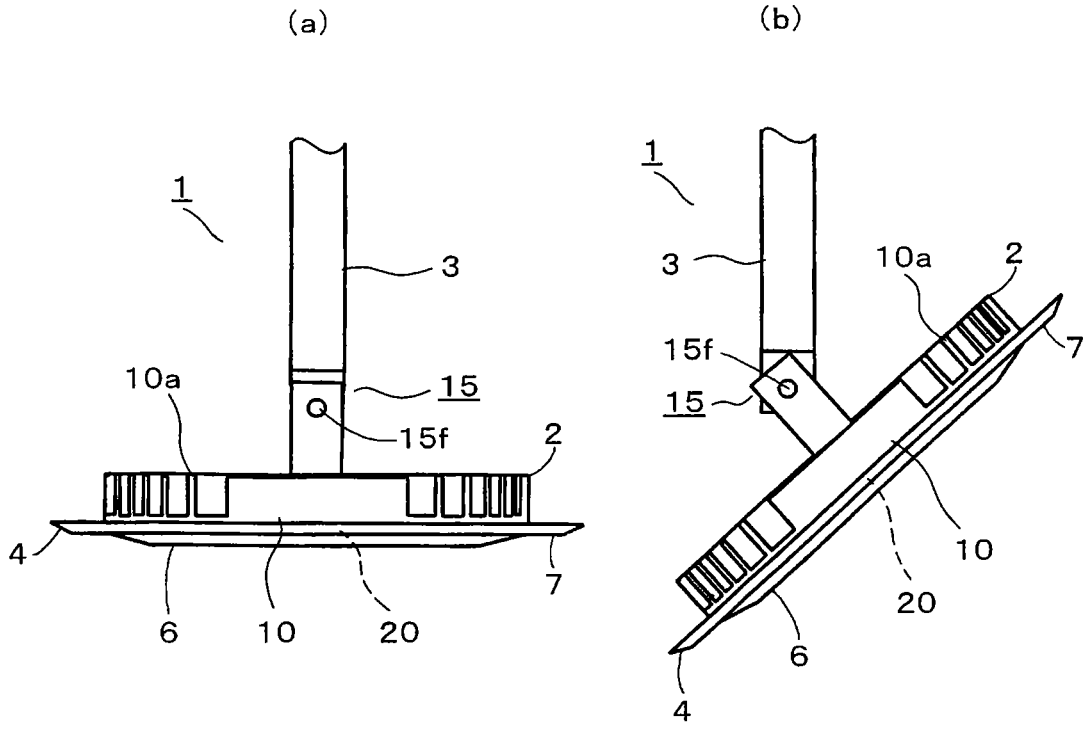
FIG. 19 shows an angle at which a change in temperature is measured in line with a change in the irradiation angle of the spotlight shown in FIG. 18, wherein (a) is a side elevational view of the horizontal position, and (b) is a side elevational view when the elevation angle is 45°.
Figure 20:
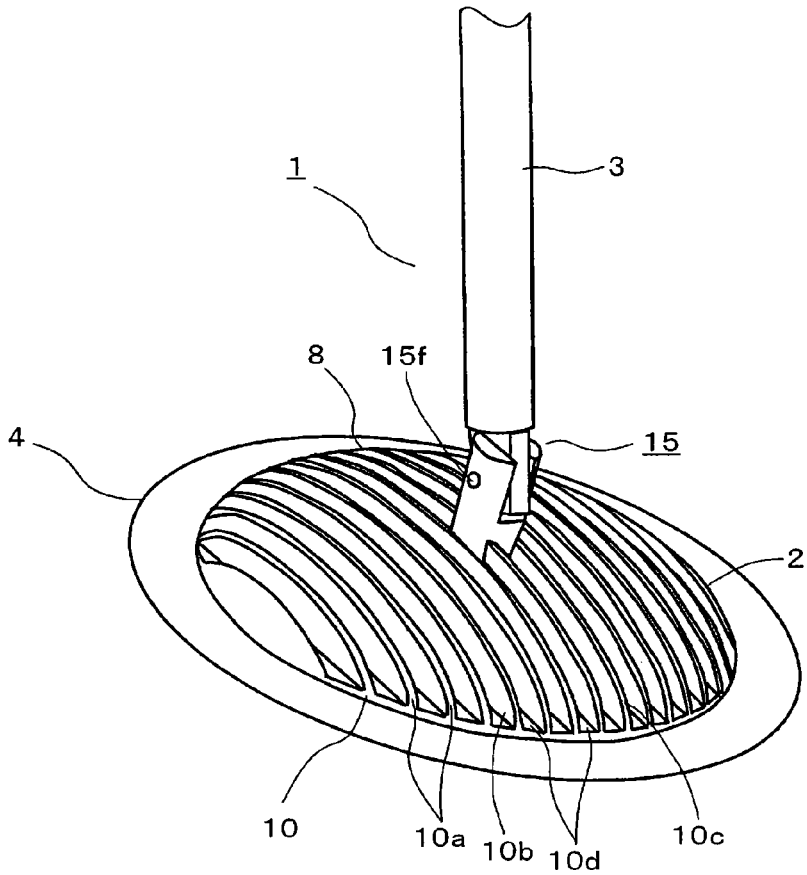
FIG. 20 is a perspective view showing the rear side of a spotlight (substantially the same as the spotlight according to the above embodiments) as another lighting system that aims at measurement of a change in temperature in line with a change in the irradiation angle of the lighting system.
Figure 21:
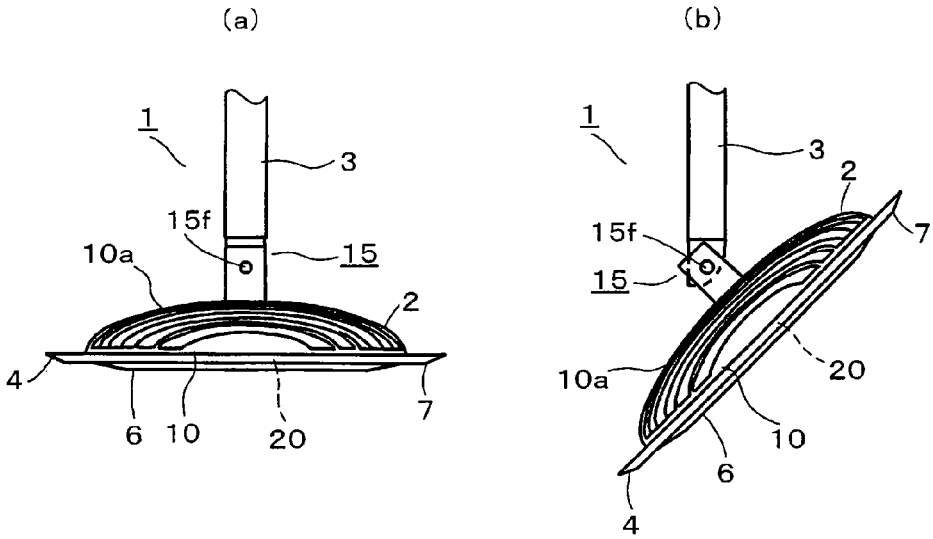
FIG. 21 shows an angle at which a change in temperature is measured in line with a change in the irradiation angle of the spotlight shown in FIG. 20, wherein (a) is a side elevational view of the horizontal position, and (b) is a side elevational view when the elevation angle is 45°.

Next, with reference to FIG. 18 through FIG. 21, a description is given of the result of having measured changes in temperature of the heat-radiating fin portion 10 in line with a change in the irradiation angle of the spotlight 1. The spotlight 1(A) which is shown in FIG. 18, and the spotlight 1(B) shown in FIG. 20 (which is substantially identical to the spotlight according to the above embodiments) are adopted as the objects to be measured. Change in the irradiation angle was determined to be the horizontal position and an elevation angle of 45° as shown in FIGS. 19(*a*) and (*b*), and FIGS. 21(*a*) and (*b*), respectively.

And, according to the result of having lit the LEDs 20 and having measured changes in temperature thereof, in the spotlight 1 (A), the temperature dropped by 9° C. at the elevation angle of 45° for the horizontal position, where the temperature difference was 9° C., and in the spotlight 1(B), the temperature dropped by 5° C. at the elevation angle of 45° for the horizontal position, where the temperature difference was 5° C. That is, the difference in temperature is slighter for the spotlight 1(B) than for the spotlight 1(A), wherein it was found that the difference became almost half.

Accordingly, where the irradiation angle is changed, changes in the optical output and light-emitting color, etc., are even less in the spotlight 1(B) than in the spotlight 1(A), wherein it could be confirmed that influence on temperature characteristics of the LEDs 20 can be prevented from occurring. It can be presumed that this is because, in view of structure, the surface area of the heat-radiating fins 10*a* at the middle part is increased in the spotlight 1(B), and because, in view of the phenomenon, the convection action of the heat-radiating fins 10*a* of the middle part is great, and the degree of change in the convection action in line with a change in the irradiation angle is slight. Therefore, such information could be obtained by which it is effective to increase the convection effect at the middle part of the heat-radiating fins 10*a* in order to reduce a change in temperature of the LEDs 20 in line with a change in the irradiation angle.

Figure 22:
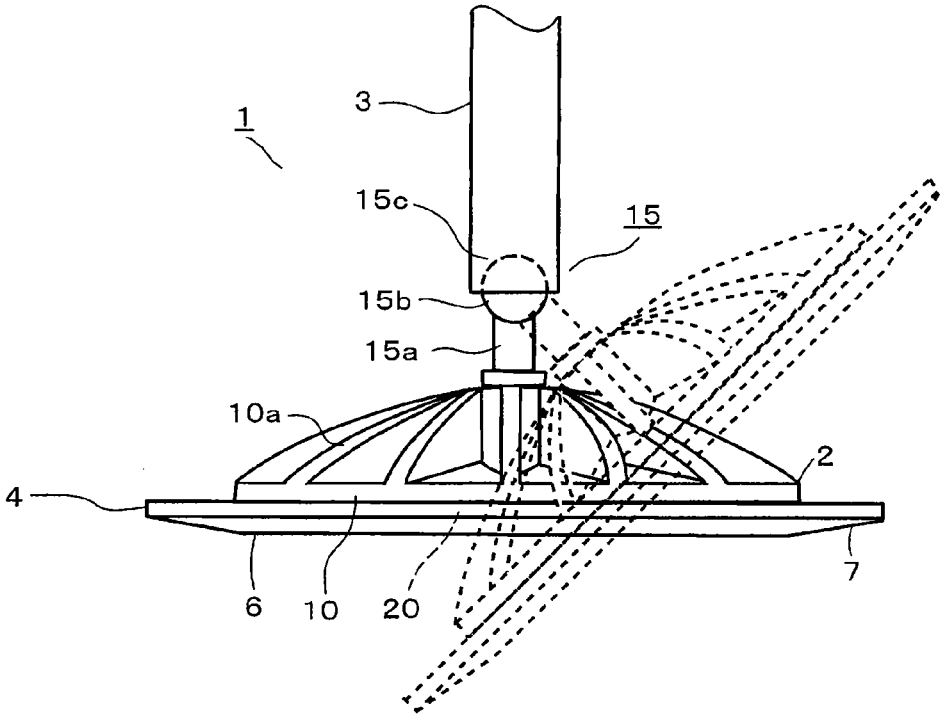
FIG. 22 is a side elevational view showing a heat-radiating structure (Example 1) of an irradiation angle changing mechanism of a lighting system according to the present invention.
Figure 23:
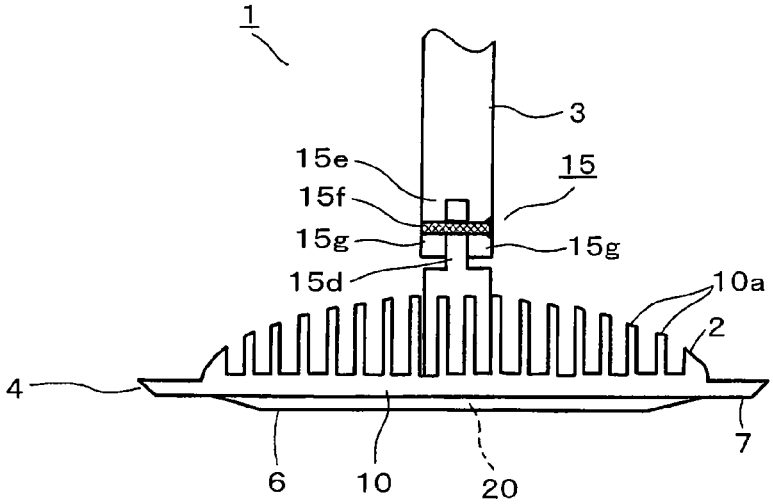
FIG. 23 is a front elevational view showing a heat-radiating structure (Example 2) of the same irradiation angle changing mechanism.
Figure 24:
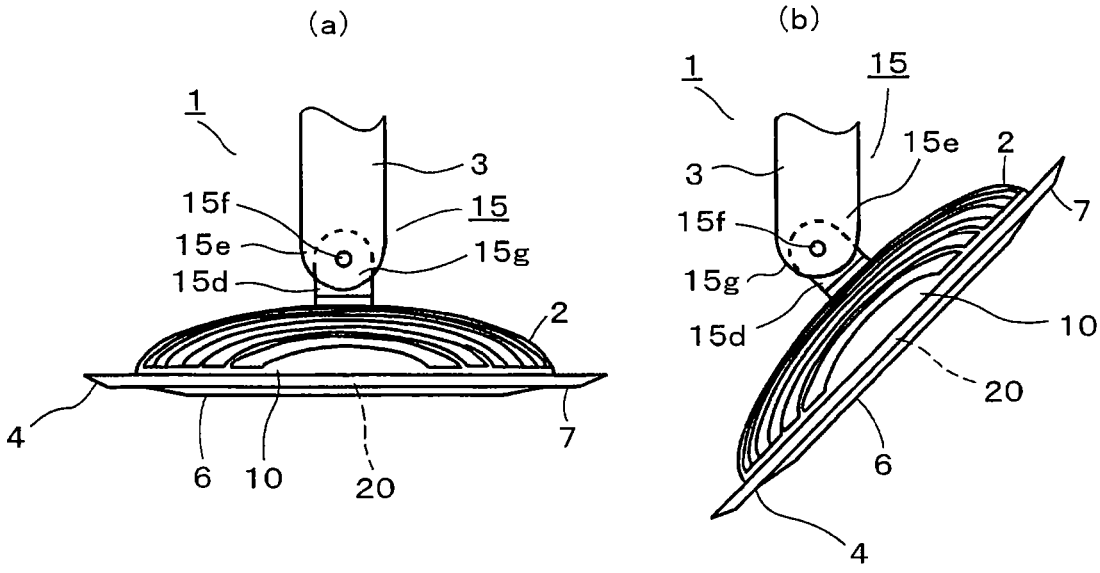
FIG. 24 is a side elevational view showing a heat-radiating structure (Example 2) of the same irradiation angle changing mechanism using (a) and (b)
Figure 25:
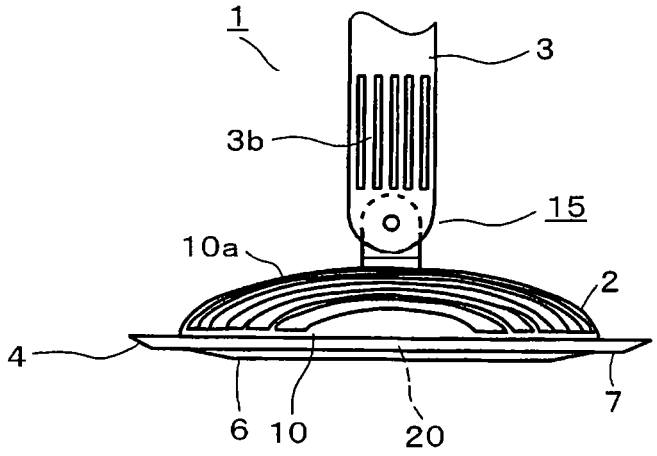
FIG. 25 is a side elevational view showing a heat-radiating structure (Example 3) of the same irradiation angle changing mechanism.

Next, a description is given of a heat-radiating structure and action of the irradiation angle changing mechanism 15 with reference to FIG. 22 through FIG. 25. FIG. 22 is a side elevational view showing a heat-radiating structure of an irradiation angle changing mechanism (Example 1). FIG. 23 is a front elevational view showing a heat-radiating structure of the irradiation angle changing mechanism (Example 2). FIG. 24 is a side elevational view showing a heat-radiating structure of the irradiation angle changing mechanism (Example 2) using (a) and (b), and FIG. 25 is a side elevational view showing a heat-radiating structure of the irradiation angle changing mechanism (Example 3). Also, components that are identical to or correspond to those of the respective Embodiments described above are given the same reference numerals, and overlapping description thereof is omitted.

FIG. 22 (Example 1) shows an irradiation angle changing mechanism 15 of the spotlight 1 according to an above embodiment. The irradiation angle changing mechanism 15 is composed of a supporting arm 15*a* and a ball portion 15*b* at the main body casing 4 side, and is composed of a ball bearing portion 15*c* at the hanging rod 3 side. These supporting arm 15*a*, the ball portion 15*b* and the ball bearing portion 15*c* are made of a material having thermal conductivity such as a metal to ensure thermal transmission. The ball bearing portion 15*c* is brought into contact with and is connected to the ball portion 15*b* so as to freely turn and enclose the ball portion 15*b*.

And, for example, even if the irradiation angle is changed so that the main body casing 4 is moved from the horizontal state shown with a solid line in FIG. 22 to a state where the main body casing 4 is tilted by 45° as shown with a broken line in FIG. 22, there is almost no change in the contact area between the ball portion 15*b* at the main body casing 4 side and the ball bearing portion 15*c* at the hanging rod 3 side.

Accordingly, heat generated at the LEDs 20 is mainly radiated by the heat-radiating fin portion 10, and is further radiated through thermal transmission to the supporting arm 15, the ball portion 15*b*, the ball bearing portion 15*c* and the hanging rod 3. And, since the contact area between the ball portion 15*b* and the ball bearing portion 15*c* is hardly changed even if the irradiation angle is changed, a change in the heat-radiating state in line with a change in the irradiation angle is only slight, wherein the change in temperature of the LEDs 20 is reduced, and this enables contributing to the prevention of adverse influence on temperature characteristics.

As shown in FIG. 23 and FIG. 24 (Example 2), the irradiation angle changing mechanism 15 is composed of a turning support axis 15*d* protruding from the heat-radiating fin portion 10 at the main body casing 4 side, the bearing portion 15*e* formed at the hanging rod 3 side and the connection axis 15*f*. At the middle part of the bearing portion 15*e*, a recessed portion in which the turning support axis 15*d* is fitted is formed, and the bearing arm 15*g* the tip end portion of which is formed to be arc-shaped is provided at both sides of the recessed portion. And, the connection axis 15*f* passes through the bearing arm 15*g* and the turning support axis 15*d*, wherein the main body casing 4 can be turned in the direction of the elevation angle centering around the connection axis 15*f*.

And, for example, even if the irradiation angle is changed so that the main body casing 4 is moved from the horizontal state shown in FIG. 24(*a*) to a state where the main body casing 4 is tilted by 45° as shown in FIG. 24(*b*), the turning support axis 15*d* at the main body casing 4 side and the inside of the bearing arm 15*g* at the hanging rod 3 side are composed so that a change in the contact area therebetween is made less. That is, since the tip end portion of the bearing arm 15*g* is formed to be arc-shaped roughly along the turning locus of the turning support axis 15*d*, a change in the contact area between the turning support axis 15*d* and the inside of the bearing arm 15*g* is reduced.

Therefore, heat generated at the LEDs 20 is radiated mainly by the heat-radiating fin portion 10, and is further radiated through thermal transmission to the turning support axis 15*d*, the connection axis 15*f*, the bearing arm 15*g* and the hanging rod 3. And, since the contact area between the turning support axis 15*d* and the bearing arm 15*g* is slight in regard to change thereof even if the irradiation angle is changed, the heat-radiating state in line with a change in the irradiation angle is only slightly changed, wherein a change in temperature of the LEDs 20 is reduced, and this enables contributing to the prevention of influence on temperature characteristics from occurring.

As shown in FIG. 25 (Example 3), a recessed groove is formed in the hanging rod 3 operating as the hanging element, a plurality of heat-radiating fins 3*b* are composed to increase the surface area, wherein the heat-radiating effect is improved. Therefore, heat generated at the LEDs 20 and transmitted therefrom can be effectively radiated by the hanging rod 3. Also, there is no special restriction in view of the shape of the heat-radiating fins 3*b*. In addition, the hanging rod 3 is attached to a lighting rail, and heat is transmitted from the hanging rod 3 to the lighting rail, whereby the heat may be radiated.

The present invention is not limited to the configurations according to the respective embodiments described above, but maybe subjected to various modifications and variations within the scope not departing from the spirit of the invention. For example, it is not necessary that the heat-radiating fins 10*a* and the grooves 10*d* along the direction of changing the elevation angle are continuous without any disconnection, wherein the heat-radiating fins 10*a* and grooves 10*d* may not be continuous if they are of such a mode by which convections are enabled. Further, the heat-radiating fins 10*a* are those that increase the surface area of the outer circumferential side of the heat-radiating fin portion 10. The heat-radiating fins 10*a* are not limited to such shapes such as fins, flat plates, ridges, etc., wherein they may be formed so as to protrude, and there is no special restriction in the shapes thereof.

What is claimed is:

1. A lighting system, comprising:

a substrate having a light emitting element disposed thereon;

a main body casing having the substrate provided thereon and a rear side portion having thermal conductivity, which is thermally coupled to the substrate, the rear side portion further having heat-radiating fins formed thereon, wherein the rear side portion is formed to be spherical in appearance; and a supporting arm protruding from a top portion of the middle part of the rear side portion;

wherein at least one of the heat-radiating fins has a portion directly connected to the supporting arm and the height of the portion directly connected to the outer surface of the supporting arm is greater than that of any other portions of the at least one of the heat-radiating fins, and each heat-radiating fin has a height so that the appearance formed by upper surfaces of the heat-radiating fins is substantially spherical.

* * * * *